US006170290B1

(12) United States Patent
Gistau-Baguer

(10) Patent No.: US 6,170,290 B1
(45) Date of Patent: Jan. 9, 2001

(54) REFRIGERATION PROCESS AND PLANT USING A THERMAL CYCLE OF A FLUID HAVING A LOW BOILING POINT

(75) Inventor: Guy Gistau-Baguer, Biviers (FR)

(73) Assignee: L'Air Liquide, Societe Anonyme pour l'Etude et l'Exploitation des Procedes Georges Claude, Paris Cedex (FR)

( * ) Notice: Under 35 U.S.C. 154(b), the term of this patent shall be extended for 0 days.

(21) Appl. No.: 09/260,495

(22) Filed: Mar. 2, 1999

(30) Foreign Application Priority Data

Mar. 2, 1998 (FR) ..... 98 02490

(51) Int. Cl.[7] ..... F25J 3/00
(52) U.S. Cl. ..... 62/608; 62/923
(58) Field of Search ..... 62/608, 923

(56) References Cited

U.S. PATENT DOCUMENTS

| | | | | |
|---|---|---|---|---|
| 3,360,955 | * | 1/1968 | Witter | 62/608 |
| 3,389,565 | * | 6/1968 | Ergenc | 62/608 |
| 3,470,065 | | 9/1969 | Ergenc . | |
| 4,267,701 | * | 5/1981 | Toscano | 62/608 |
| 4,346,563 | * | 8/1982 | Hood | 62/608 |
| 4,498,313 | * | 2/1985 | Hosoyama et al. | 62/608 |
| 4,606,744 | | 8/1986 | Kundig . | |
| 5,265,426 | * | 11/1993 | Gistau-Baguer | 62/608 |

FOREIGN PATENT DOCUMENTS

| | | |
|---|---|---|
| 1 540 391 | 9/1968 | (FR) . |
| 2 026 570 | 9/1970 | (FR) . |
| 2 343 211 | 9/1977 | (FR) . |
| 2 401 392 | 3/1979 | (FR) . |
| 6-101918 | 4/1994 | (JP) . |
| 8-285395 | 11/1996 | (JP) . |
| 9-170834 | 6/1997 | (JP) . |

* cited by examiner

*Primary Examiner*—Ronald Capossela
(74) *Attorney, Agent, or Firm*—Young & Thompson

(57) ABSTRACT

In this process, the fluid is compressed (at 2) in the gaseous state to a pressure called the high pressure, the fluid is precooled on passing through a precooling first stage (3), cooled and liquefied, at least partially, on passing through a cooling second stage (4), at least some of the cooled and expanded fluid is collected in a tank (5) for storing the fluid in a two-phase state and some of the gas phase is sent back via a warming line (7) from the tank through the first and second stages. The precooled fluid is divided into at least two separate streams which are expanded in parallel in the second stage, mainly a first stream intended to supply, at least partly, a first source of refrigeration (at 8), and at least a second stream, one of these streams being partially liquefied separately (at 27) on passing through the second stage (4). The process is applicable to the cooling of superconducting components using helium.

16 Claims, 5 Drawing Sheets

Figure 1:
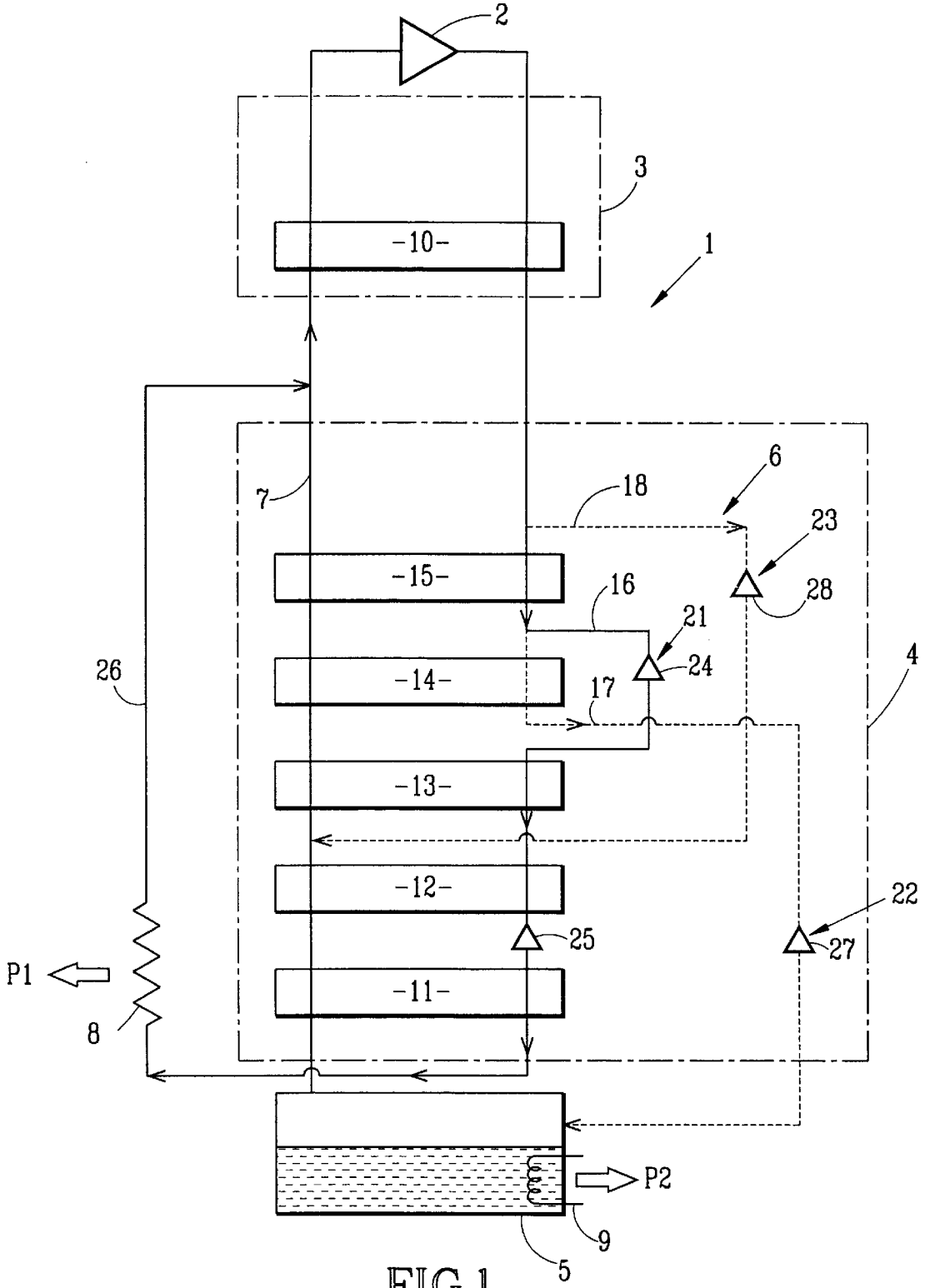

REFRIGERATION PROCESS AND PLANT USING A THERMAL CYCLE OF A FLUID HAVING A LOW BOILING POINT

FIELD OF THE INVENTION

The present invention relates to a refrigeration process, using a thermal cycle of a fluid having a low boiling point, especially helium, in which:

- the fluid is compressed in the gaseous state to a pressure called the high pressure,
- the compressed fluid is precooled on passing through a precooling first stage,
- the compressed and precooled fluid is cooled and liquefied, at least partially, on passing through a cooling and liquefying second stage where the fluid is expanded to a pressure called the low pressure,
- at least some of the cooled and expanded fluid is collected in a tank for storing the fluid in a two-phase state,
- some of the gas phase is sent back via a warming line from the tank successively through the second and first stages, this gas phase being warmed on passing through these stages by heat exchange with the compressed fluid passing through them,
- at least some of the cooled and expanded fluid forming a first force of refrigeration.

The invention applies in particular to the cooling of superconducting components of particle accelerators, using helium.

The pressures involved here are absolute pressures.

BACKGROUND OF THE INVENTION

The cooling of the superconducting elements requires the use of fluids at very low temperatures, generally below 5 K, these fluids forming sources of refrigeration placed in heat-exchange relationship with the components.

A fluid having a low boiling point, such as helium, allows such temperatures to be reached inside the storage tank where it is in a liquid/vapour equilibrium state.

Thus, it is possible, for example, to use the liquid phase contained in this tank as the source of refrigeration, by evaporating the liquid phase and optionally warming the gas thus produced.

This vaporization may take place inside the actual tank, the cold source then being isothermal and the corresponding refrigeration plant operating in a so-called refrigerating mode.

The vaporization may also take place outside the tank, after drawing off the liquid phase contained in the latter, the corresponding refrigeration plant then operating in a so-called liquefying mode. In this mode of operation, the gas thus produced is also used as the source of refrigeration, by warming it.

Finally, these two modes of operation may be combined in a mixed mode of operation, in which two sources of refrigeration are provided, namely a first source outside the storage tank and an isothermal second source actually inside this tank.

The production of refrigerating power at the required temperatures entails a high operating cost which corresponds to the compression requirements of the fluid used.

OBJECT OF THE INVENTION

The object of the invention is to solve these problems by providing, in particular, a refrigeration process which can be used for all the modes of operation described above, making it possible to optimize the overall compression power budget and therefore to reduce the operating costs of the plants.

SUMMARY OF THE INVENTION

For this purpose, the subject of the invention is a refrigeration process, using a thermal cycle of a fluid having a low boiling point, especially helium, in which:

- the fluid is compressed in the gaseous state to a pressure called the high pressure,
- the compressed fluid is precooled on passing through a precooling first stage,
- the compressed and precooled fluid is cooled and liquefied, at least partially, on passing through a cooling and liquefying second stage where the fluid is expanded to a pressure called the low pressure,
- at least some of the cooled and expanded fluid is collected in a tank for storing the fluid in a two-phase state,
- some of the gas phase is sent back via a warming line from the tank successively through the second and first stages, this gas phase being warmed on passing through these stages by heat exchange with the compressed fluid passing through them,
- at least some of the cooled and expanded fluid forming a first force of refrigeration,
- characterized in that the precooled fluid is divided into at least two separate streams which are expanded in parallel in the second stage, namely a first stream intended to supply, at least partly, the first source of refrigeration and at least a second stream, one of these streams being at least partially liquefied separately on passing through the second stage.

Depending on the particular embodiments, the process may comprise one or more of the following characteristics, taken alone or in any technically possible combination:

- the first stream is at least partially liquefied on passing through the second stage in order to feed the storage tank;
- at least a second stream is liquefied, at least partially and separately, in the second stage, in order also to feed the storage tank with fluid;
- the liquid phase contained in the tank is used to form the first source of refrigeration;
- some of the liquid phase is drawn off from the storage tank in order to form the first source of refrigeration outside the said tank;
- the liquid phase contained in the storage tank is used as an isothermal second source of refrigeration inside this tank;
- the first source of refrigeration is a gas, especially a supercritical gas, which is produced from the first stream, and the storage tank is fed from a second stream at least partially liquefied in the second stage;
- the gas is cooled downstream of the second stage, by heat exchange with the liquid phase stored in the tank, in order to form the first source of refrigeration;
- the liquid phase contained in the storage tank is used as an isothermal second source of refrigeration inside this tank;
- the first stream is furthermore cooled, in at least part of the second stage, by countercurrent heat exchange using another of the expanded streams;
- the other stream, cooled and expanded into a gas phase in the second stage, is sent back directly to the warming line in order to cool the first stream in the second stage, the other stream, expanded and cooled into at least one gas phase, is sent back to the storage tank, the gas phase being sent back via the warming line in order to cool the first stream in the second stage.

The subject of the invention is also a plant for implementing a process as defined above, characterized in that it comprises means for compressing the fluid, a precooling first stage, a cooling and expansion second stage, a tank for storing the fluid in a two-phase state, a line for cooling the compressed fluid, which, at least partly, passes through the two stages and connects the compression means to the tank, a line for warming the gas phase of the tank, which passes through the two stages and communicates with the said tank, in that the cooling line is divided in the second stage into at least two separate pipes, each provided with its own expansion, means, belonging to the second stage, a first of these pipes, the pipe corresponding to a first stream, being intended to supply, at least partly, a first source of refrigeration, and in that expansion means of one of the pipes comprise means of at least partial liquefaction.

Depending on particular embodiments, the plant may comprise one or more of the following characteristics, taken alone or in any technically possible combination:

the expansion means of the first pipe comprise means of at least partial liquefaction and this first pipe emerges in the storage tank in order to feed it with fluid;

the expansion means of at least one second pipe, corresponding to a second stream, comprise means of at least partial liquefaction and this second pipe also emerges in the storage tank in order to feed it with fluid;

the plant comprises means for bringing the liquid phase of the storage tank into heat-exchange relationship with the outside, in order to use this liquid phase as the first source of refrigeration;

the plant comprises means for drawing off the liquid phase from the storage tank in order to form the first source of refrigeration outside the tank;

the plant comprises means for bringing the liquid phase contained in the storage tank into heat-exchange relationship with the outside of the tank, in order to form an isothermal second source of refrigeration inside this tank;

the expansion means of a second pipe, corresponding to a second stream, comprise means of at least partial liquefaction, this second pipe emerges in the tank in order to feed it with fluid, and the expansion means of the first pipe are means for expanding the fluid into a gas, in order to supply, at one outlet, a gas, especially a supercritical gas, forming the first source of refrigeration;

the first pipe is, downstream of the second stage, in heat-exchange relationship with the liquid phase of the storage tank, in order to cool the gas to be supplied in order to form the first source of refrigeration;

the plant comprises means for bringing the liquid phase contained in the tank into heat-exchange relationship with the outside of the tank, in order to form an isothermal second source of refrigeration inside this tank;

in at least part of the second stage, the first pipe is in heat-exchange relationship with another of the pipes in order to cool the first stream by countercurrent heat exchange in the second stage;

the expansion means of the other pipe comprise means of expansion into a gas phase, and the other pipe emerges directly in the warming line;

the expansion means of the other pipe comprise means of expansion into at least one gas phase, and this other pipe emerges in the tank in order for the gas phase to be sent via the warming line in order to cool the first stream in the second stage;

the expansion means of the pipes comprise turbines; and a pipeline for returning a fluid emerges in the warming line between the first stage and the second stage, and the second stage comprises a heat exchanger which brings the cooling and warming lines into heat-exchange relationship with each other, the heat exchanger being placed upstream of the expansion means of at least one of the pipes.

BRIEF DESCRIPTION OF THE INVENTION

Figure 2:
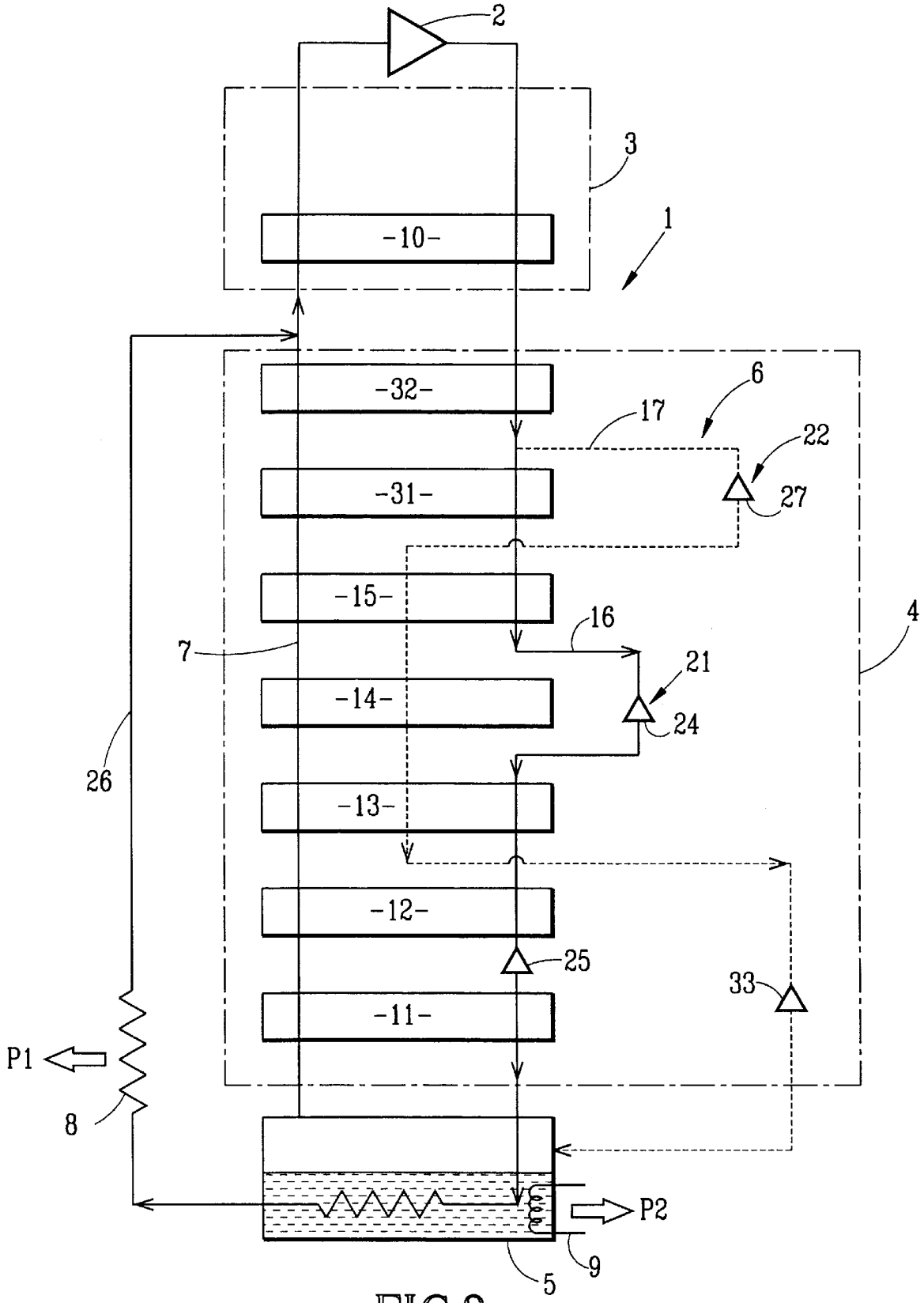
Figure 3:
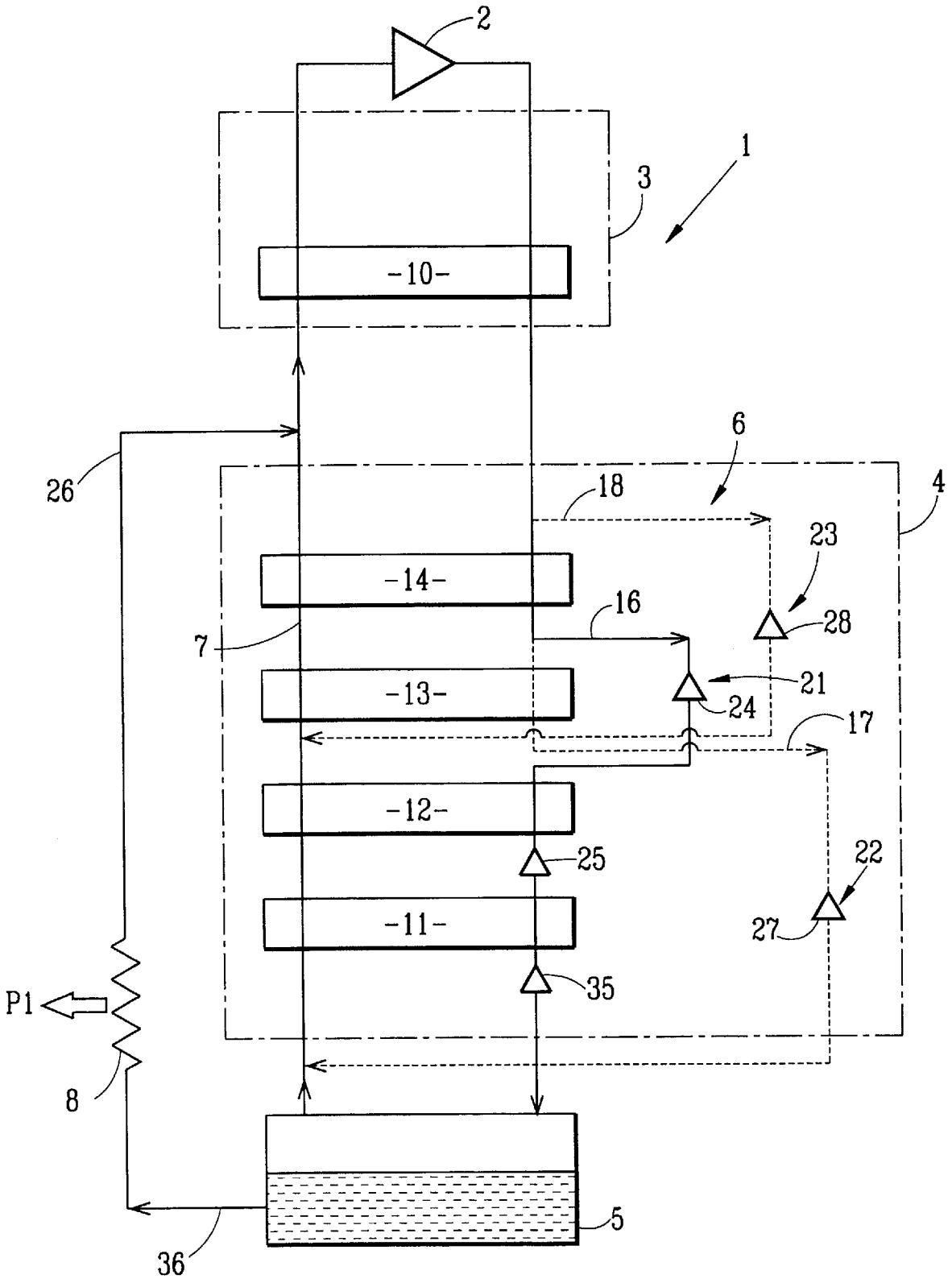
Figure 4:
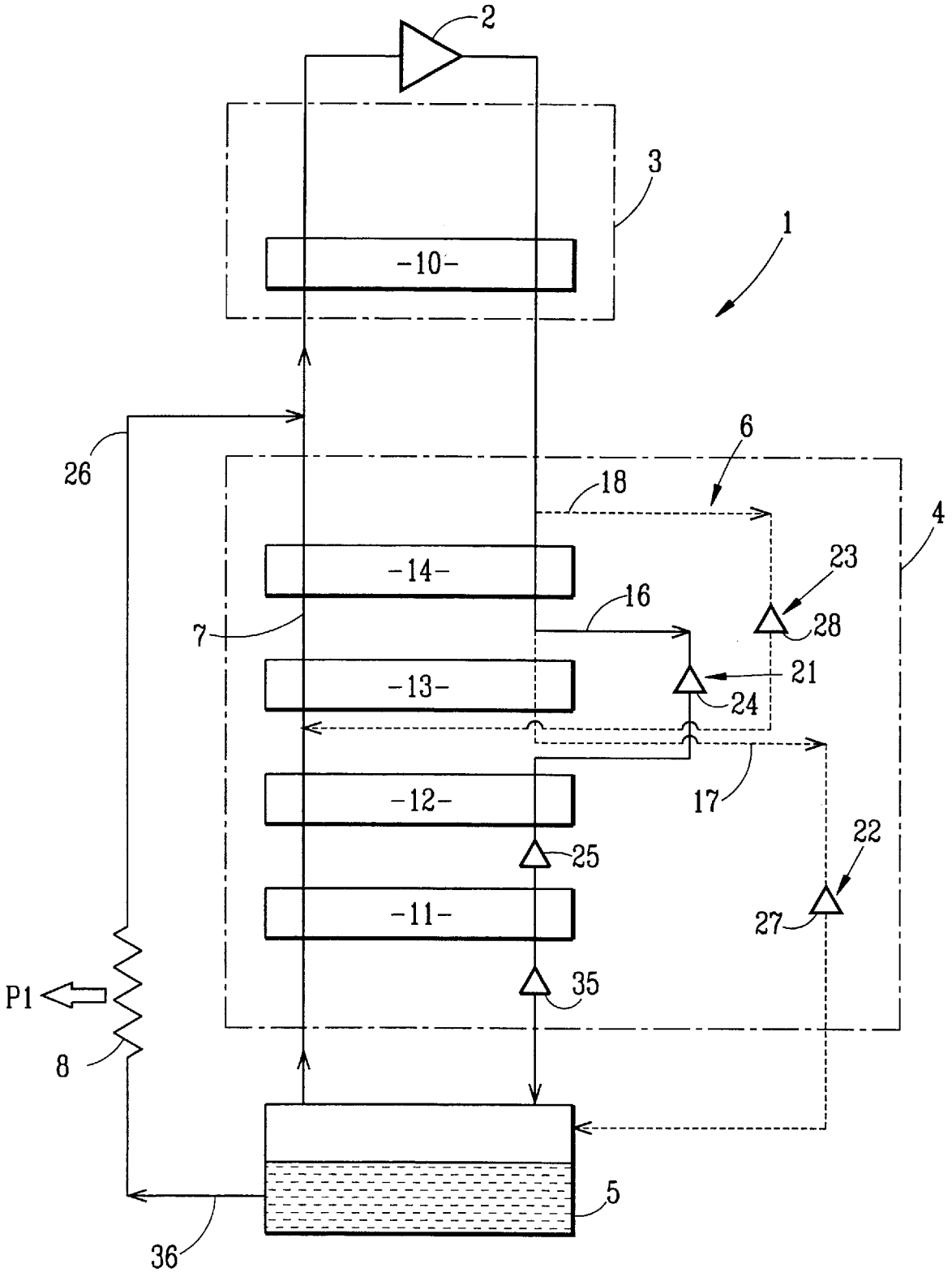
Figure 5:
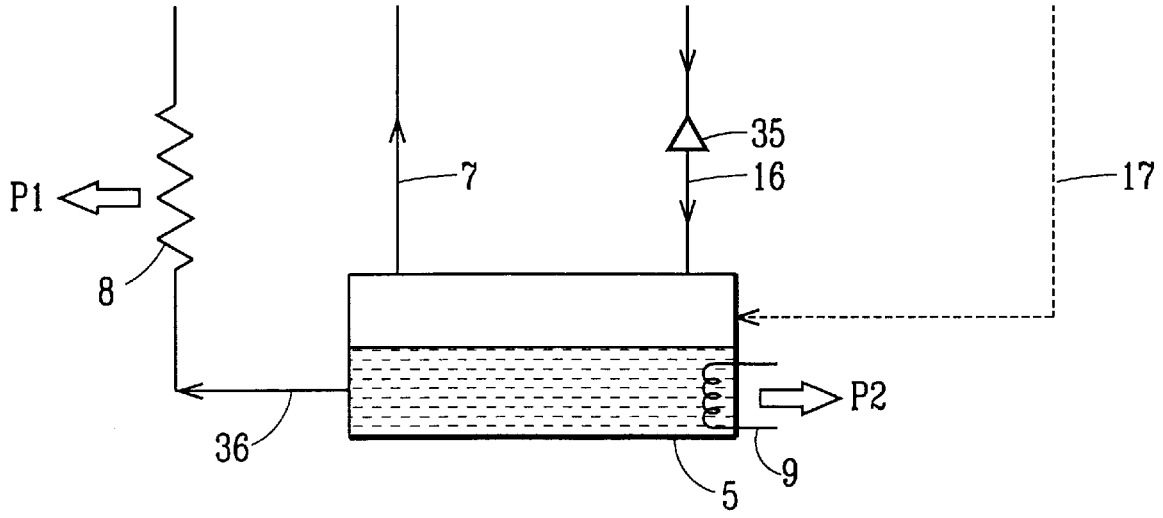
Figure 6:
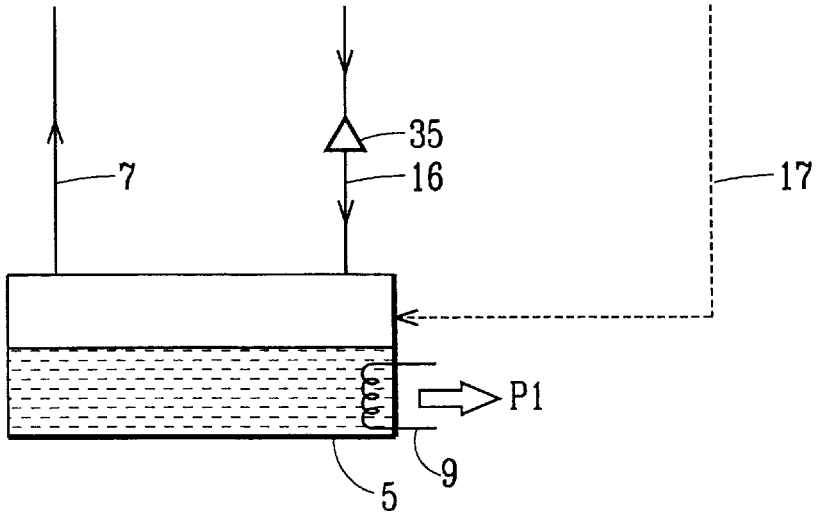

The invention will be more clearly understood on reading the following description, given solely by way of example, and with reference to the appended drawings in which:

FIG. 1 is a diagrammatic view illustrating a first embodiment of a refrigeration plant according to the invention, FIGS. 2 and 3 are diagrammatic views illustrating a second and a third embodiment, respectively, of a refrigeration plant according to the invention, FIG. 4 is a view similar to FIG. 3, illustrating an alternative form of the plant in FIG. 3, and FIGS. 5 and 6 are diagrammatic views of the cold end of the alternative form of the plant in FIG. 4.

DETAILED DESCRIPTION OF THE INVENTION

FIG. 1 shows a refrigeration plant 1, using a helium closed thermal cycle, in order to cool superconducting components (not shown) by supplying a first refrigerating capacity P1 and isothermal second refrigerating capacity P2.

This plant 1 comprises essentially:

cycle compression means, comprising several compressors 2 which are placed in series, only one of which is shown in FIG. 1, a first stage 3, for precooling helium, a second stage 4, for cooling and expanding helium, a storage tank 5, for storing helium in liquid/vapour equilibrium, a line 6 for cooling compressed helium, which line at least partly connects the compression means 2 to the storage tank 5 and passes in succession through the first stage 3 and the second stage 4, and a line 7 for warming the gas phase of the tank 5, which line connects this tank 5 to the compression means 2 and which passes in succession through the second stage 4 and the first stage 3.

The plant 1 furthermore comprises, on the one hand, a heat exchanger 8, placed away from the other components of the plant 1 in order to supply the refrigerating capacity P1 to a first superconducting component and, on the other hand, means 9 for bringing the lower part of the tank 5 into heat-exchange relationship with another superconducting component, in order to supply the isothermal refrigerating capacity P2.

The first stage 3 comprises several countercurrent heat exchangers 10, only one of which is shown.

The second stage 4 comprises five countercurrent heat exchangers 11 to 15, placed in succession between the tank 5 and the first stage 3, and expansion means which will be explained below.

In the plant 1, the helium is compressed to a pressure of approximately 20 bar by the compression means 2 and then this helium is sent, via the cooling line 6, through the precooling stage 3 where this helium is precooled.

On leaving this first stage 3, the helium is at a pressure of approximately 19.25 bar and a temperature of approximately of 20.54 K, i.e. at a temperature below its Joule-Thomson inversion temperature, which at this pressure is approximately 37 K.

This precooled gaseous helium is then sent at a mass flow rate of approximately 764 g/s, via the cooling line 6, through the second stage 4, where this gaseous helium is divided into three streams, each conveyed by a separate pipe 16, 17, 18 of the line 6, the second pipe 17 and third pipe 18 being shown as dotted lines in FIG. 1 for the sake of clarity.

The line 6 is therefore divided inside the second stage 4 into three pipes 16 to 18, each provided with its own expansion means 21, 22, 23.

A first stream and a second stream, corresponding to mass flow rates of approximately 244 g/s and 248 g/s respectively, together pass through the heat exchanger 15 where they are cooled down to a temperature of approximately 13.39 K.

This first stream and this second stream are then separated and conveyed through the first pipe 16 and the second pipe 17, respectively.

The first stream is firstly expanded and cooled in a turbine 24 of the expansion means 21 of the first pipe 16, before being introduced into the heat exchanger 13 at a pressure of approximately 9.50 bar and a temperature of approximately 10.78 K.

This first stream is then cooled on passing through the heat exchanger 13, down to a temperature of approximately 9.31 K, and then on passing through the heat exchanger 12 down to a temperature of approximately 8.34 K.

Next, the first stream is expanded and cooled in a turbine 25 of the expansion means 21, to a pressure of approximately 3.01 bar and a temperature of 5.40 K, and then cooled on passing through the heat exchanger 11, on the output side of which this helium reaches a temperature of approximately 4.46 K.

The first stream is then in the form of a supercritical gas which is sent to the heat exchanger 8 where it is used as the first source of refrigeration in order to supply the capacity P1 by being warmed.

This first stream is finally sent at a pressure of approximately 1.24 bar and a temperature of approximately 20.22 K, via a pipe 26, between the first stage 3 and the second stage 4, into the warming line 7.

This first stream is then warmed in the first stage 3, by countercurrent indirect heat exchange with the compressed helium passing through this first stage 3, after which it then feeds the compression means 2.

On leaving the heat exchanger 15, the second stream is cooled on passing through the exchanger 14, down to a temperature of approximately 10.28 K, and then liquefied in a low proportion (approximately 10% of the mass flow rate of the second stream) in a turbine 27 of the expansion means 22 of the second pipe 17. The two-phase fluid thus produced at a temperature of approximately 4.40 K and a pressure of approximately 1.20 bar, then feeds the tank 5 with helium in liquid/vapour equilibrium.

The low proportion of liquefied helium in the second pipe 17 allows only a single turbine 27 to be used to expand the compressed helium and to liquefy it, without any risk of damaging the turbine.

By virtue of the means 9 for bringing the liquid phase contained in the storage tank 5 into heat-exchange relationship with the outside of this tank, the liquid phase supplies the refrigerating capacity P2, by being vaporized, and therefore forms an isothermal second source of refrigeration inside this tank 5.

The gas phase contained in the tank 5, comprising the gaseous part of the second stream, is sent, via the line 7, successively through the heat exchangers 11 and 12 where this gas phase is warmed up to a temperature of approximately 9.16 K. Next, this gas phase is warmed by passing through the heat exchanger 13 up to a temperature of approximately 10.14 K. This gas phase is warmed by countercurrent indirect heat exchange with the first stream passing through these heat exchangers 11, 12 and 13.

Next, this gas phase is warmed on passing through the heat exchanger 14 up to a temperature of approximately 12.02 K, by countercurrent indirect heat exchange with the second stream passing through this exchanger 14, and then warmed on passing through the exchanger 15, up to a temperature of approximately 20.22 K, by countercurrent indirect heat exchange with the first and second streams passing through this exchanger 15.

Thus, the gaseous part of the second stream on leaving the turbine 27 is used to cool the first and second streams.

Finally, this gas phase, together with the gas sent via the pipe 26, is warmed in the first stage 3 before it feeds the compression means 2.

The third stream, corresponding to a mass flow rate of approximately 272 g/s and conveyed in the third pipe 18, is expanded and cooled separately in a turbine 28 of the expansion means 23 of the third pipe 18. On leaving this turbine 28, the helium is in the gas phase, at a pressure of approximately 21.19 bar and a temperature of approximately 9.16 K.

Next, the expanded third stream is sent directly into the warming line 7 between the heat exchangers 13 and 12. This third stream, together with the vapour phase conveyed in the warming line 7, is then warmed in the heat exchangers 13 to 15 by countercurrent indirect heat exchange with the other streams passing through these exchangers 13 to 15. This third stream therefore helps to cool the first and second streams.

Finally, this third stream, together with the gas phase conveyed by the warming line 7, is warmed on passing through the first stage 3 before it feeds the compression means 2.

This plant 1 makes it possible to produce a first refrigerating capacity P1 of approximately 21700 W, using supercritical helium at approximately 4.46 K, and an isothermal second refrigerating capacity P2 of approximately 4800 W, using liquid helium at approximately 4.40 K.

The separate and parallel expansion of the three streams makes it possible, on the one hand, to obtain the two separate sources of refrigeration and, on the other hand, to use the third stream to cool the first stream and/or the second stream over the temperature range defined by the exchangers 13 to 15 and to use part of the second stream to cool the first and second streams.

These characteristics make it possible to optimize the overall budget in terms of compression power consumed in the plant 1, which corresponds to a power of approximately 4.5 MW.

FIG. 2 illustrates a second embodiment of a refrigeration plant 1 of FIG. 1, this being distinguished from that in FIG. 1 by the following.

A sixth countercurrent heat exchanger 31 and a seventh countercurrent heat exchanger 32 are placed in the second stage 4, upstream of the exchanger 15 with respect to the flow of helium in the cooling line 6.

The warming line 7 passes through each of the heat exchangers 31 and 32.

In this plant 1, the gaseous helium precooled in stage 3 is introduced via the cooling line 6 into the second stage 4, where this helium is firstly cooled on passing through the heat exchanger 32 by countercurrent indirect heat exchange with the gas phase conveyed by the warming line 7. This helium is then divided into two separate streams, which are conveyed by a first pipe 16 and a second pipe 17 of the line 6, respectively.

The first stream is cooled on passing through the heat exchanger 31. In a similar manner to the case of the plant 1 in FIG. 1, this first stream is then cooled in the heat exchanger 15, expanded and cooled in the turbine 24, cooled successively in the heat exchangers 13 and 12, expanded and cooled in the turbine 25 and, finally, cooled on passing through the heat exchanger 11.

Downstream of the second stage, the pipe 16 is immersed in the liquid phase contained in the storage tank 10. The first stream, in the form of supercritical helium, is then cooled by vaporization of part of this liquid phase before being supplied to the exchanger 8.

The second stream is firstly expanded and cooled in a turbine 27 of the expansion means 22 of the second pipe 17 and then it is introduced in gaseous form successively into the exchangers 15 to 13, where this second stream is cooled by countercurrent indirect heat exchange with the gas phase conveyed by the warming line 7. Next, this gaseous helium is expanded and cooled in a turbine 33 of the expansion means 22 where this helium is partially liquefied. The two-phase fluid produced on leaving this turbine 33 is then sent to the storage tank in order to feed it with helium in liquid/vapour equilibrium.

This plant also makes it possible to achieve the objectives fixed at the start of the description.

Furthermore, the presence of the seventh exchanger 32 makes it possible to decouple the temperature of the first stream, sent back via the pipe 26 from the heat exchanger 8 to the warming line 7, from the temperature of the second stream entering the turbine 22.

FIG. 3 illustrates a third embodiment of a refrigeration plant 1, this being distinguished from that in FIG. 1 by the following.

This plant 1 is intended for producing a single refrigerating capacity PI in the exchanger 8, by vaporizing and warming liquid helium drawn off from the storage tank 5. This plant 5 is therefore intended to operate in liquefying mode.

The second stage 4 comprises four countercurrent heat exchangers 11 to 14 placed in succession between the storage tank 5 and the first stage 3.

The helium compressed by the compression means 2 and then precooled in passing through the first stage 3, is sent, via the cooling line 6, into the second stage 4. This precooled gaseous helium is divided into three streams, these being conveyed by a first pipe 16, a second pipe 17 and a third pipe 18 of the cooling line 6, respectively.

The first and second streams are firstly cooled together on passing through the heat exchanger 14 and then separated into two separate streams on leaving this exchanger 14.

Next, the first stream is expanded and cooled on passing through a turbine 24 of the expansion means 21 of the first pipe 16, then cooled in the heat exchanger 12, expanded and cooled in a turbine 25 of the expansion means 21, cooled in the heat exchanger 11 and, finally, partially liquefied on passing through a third turbine 35 of the expansion means 21. The first stream is then introduced in two-phase form into the storage tank 5. The gaseous part of this first stream is conveyed by the warming line 7, where it is warmed in the heat-exchangers 11 to 14, thereby cooling, on the one hand, the first stream passing through these exchangers 11, 12 and 14 and, on the other hand, the second stream in the exchangers 13 and 14, as described below.

The liquid phase contained in the tank 5 is drawn off via a pipe 36 in order to feed the heat exchanger 8 where this liquid phase is vaporized and then warmed, thereby supplying the refrigerating capacity P1. The gas phase thus produced is sent back by a pipe 26 to the warming line 7, between the two stages 3 and 4.

On leaving the heat exchanger 14, the second stream is sent, via the second pipe 17, into this heat exchanger 13 where it is cooled, and then this second stream of gaseous helium is expanded and cooled on passing through a turbine 27 of the expansion means 22 of the second pipe 17 before being sent back directly into the warming line 7, between the storage tank 5 and the heat exchanger 11.

This second stream, conveyed by the warming line 7, then passes in succession through the heat exchangers 11 and 12, where this stream is warmed, thereby cooling the first stream passing through these two exchangers, and then the heat exchanger 13, in which this stream is warmed, thereby cooling the second stream passing through this exchanger, and, finally, the heat exchanger 14 where this stream is warmed, thereby cooling the first and second streams passing through this exchanger. Next, this second stream, together with the gas phase sent back by the pipe 26, is sent through the first stage 3 to the compression means 2.

The third stream is expanded and cooled on passing through a turbine 28 of the expansion means 23 of the third pipe 18 and then sent directly, in the gas phase, to the warming line 7 between the heat exchangers 12 and 13.

This third stream, conveyed by the warming line 7, is then warmed on passing through the heat exchanger 13, thereby cooling the second stream passing through this heat exchanger, and then warmed on passing through the heat exchanger 14, thereby cooling the first and second streams passing through this heat exchanger 14. Next, this third stream is sent back to the first stage 3 and the compression means 2 via the heating line 7.

This embodiment also makes it possible to achieve the objectives fixed at the start of the description.

FIG. 4 illustrates an alternative embodiment of the plant 1 in FIG. 3, this being distinguished from the latter by the following.

On passing through the turbine 27, the second stream is liquefied in a low proportion and then sent directly into the storage tank 5 in order to feed it with fluid in liquid/vapour equilibrium.

The gaseous part of the second stream, introduced into the storage tank 5, is conveyed by the warming line 7 where it is warmed by cooling the first stream in the exchangers 11 and 12, by cooling the second stream in the exchanger 13 and by cooling the first and second streams in the exchanger 14.

As in FIG. 3, the warming line 7 is therefore fed with the gas phase by the gas phases supplied by the three streams which are used to cool the first and second streams in the second stage.

Of course, the plant 1 in FIG. 4 may also operate, in an alternative embodiment, in mixed mode, as illustrated in FIG. 5. This FIG. 5 illustrates the cold end of a refrigeration plant 1, i.e. the bottom part (as seen in FIG. 4) surrounding the storage tank 5. In this alternative embodiment, the plant 1 comprises means for bringing the bottom part of the tank 5 into heat-exchange relationship with the outside, in order to supply a refrigerating capacity P2.

The plant 1 in FIG. 4 may also operate, according to another alternative embodiment, in refrigerating mode, as illustrated in FIG. 6. According to this alternative embodiment, the heat exchanger 8 and the pipe 26 have been omitted, and the plant 1 comprises means 9 for bringing the bottom of the tank 5 into heat-exchange relationship with the outside. The liquid phase contained in the tank 5 then forms the first source of refrigeration inside the tank 5 and supplies an isothermal refrigerating capacity P1.

What is claimed is:

1. A refrigeration process, using a thermal cycle of a fluid having a low boiling point, comprising:

compressing said fluid in the gaseous state to a first pressure to obtain a compressed fluid;

precooling the compressed fluid by passing it through a first cooling stage to obtain a compressed and precooled fluid;

cooling and at least partially liquefying the compressed and precooled fluid by passing it through a second cooling stage comprising at least two successive heat exchangers to obtain a cooled and partially liquefied fluid;

collecting at least some of said cooled and partially liquefied fluid in a tank;

circulating and heating part of the fluid from the tank in a warming line passing successively through the second and first cooling stages;

wherein the compressed and precooled fluid is split into at least two parallel first and second streams; the process further comprising expanding the first stream in a turbine arranged between two successive exchangers of the second cooling stage; and at least partially expanding the second stream in a turbine arranged in parallel to at least one of said successive heat exchangers of the second cooling stage.

2. The process according to claim 1, wherein part of the cooled fluid leaving the second cooling stage is made available as a first source of refrigeration.

3. The process according to claim 2, wherein part of the liquid phase contained in the tank is used as the first source of refrigeration.

4. The process according to claim 1, wherein part of the fluid in the tank is made available as a second source of refrigeration.

5. The process according to claim 4, wherein a liquefied part of the second stream is supplied to the tank.

6. The process according to claim 1, further comprising cooling the first stream in at least part of the second cooling stage by countercurrent heat exchange with one other fluid stream.

7. The process according to claim 6, further comprising cooling and expanding said other stream and sending it in a gas phase into the second cooling stage towards the warming line for cooling the first stream.

8. The process according to claim 6, further comprising expanding and cooling said other stream and sending it at least in a gas phase to the tank; said gas phase being extracted from the tank via the warming line for cooling the first stream.

9. The process according to claim 1, wherein the fluid having a low boiling point is helium.

10. A refrigeration plant using a thermal cycle of a low boiling point fluid, comprising, serially arranged:

a compressing means for compressing the fluid;

a first cooling stage fluidly connected to said compressing means for precooling the fluid;

a second cooling stage fluidly connected to said first cooling stage and comprising at least two successive heat exchangers for cooling precooled fluid;

a tank fluidly connected to said second cooling stage for storing cooled fluid in a two-phase stage;

a cooling line for passing the fluid from the compressing means to the tank through the first and second cooling stages;

a warming line for passing the fluid in a gas phase from the tank back to the compressing means;

wherein the cooling line is divided in the second cooling stage into at least first and second conduits; the first conduit including at least one expansion turbine located between two successive exchangers of the second cooling stage; and the second conduit including at least one expansion turbine bypassing at least one of said successive exchangers.

11. The plant according to claim 10, wherein the first conduit emerges into the tank.

12. The plant according to claim 11, wherein the second conduit emerges also into the tank.

13. The plant according to claim 10, further comprising exchange means for bringing the liquid phase in the tank into heat-exchange relationship with at least one outside equipment.

14. The plant according to claim 10, wherein, in at least part of the second cooling stage, the first conduit is in heat-exchange relationship with at least one other conduit for cooling the first stream by countercurrent heat exchange.

15. The plant according to claim 14, wherein said other conduit emerges directly into the warming line.

16. The plant according to claim 10, further comprising a bypass return line for returning cooled fluid; the bypass line emerging into the warming line at a location between the first cooling stage and the second cooling stage, and wherein the second cooling stage comprises a heat exchanger for bringing the cooling and warming lines into heat-exchange relationship with each other.

* * * * *